US007063202B2

(12) United States Patent
Ossendorf

(10) Patent No.: US 7,063,202 B2
(45) Date of Patent: Jun. 20, 2006

(54) MOVING WALKWAY

(75) Inventor: Marc Ossendorf, Bochum (DE)

(73) Assignee: Kone Corporation, Helsinki (FI)

( * ) Notice: Subject to any disclaimer, the term of this patent is extended or adjusted under 35 U.S.C. 154(b) by 0 days.

(21) Appl. No.: 11/211,730

(22) Filed: Aug. 26, 2005

(65) Prior Publication Data

US 2005/0279610 A1 Dec. 22, 2005

Related U.S. Application Data

(63) Continuation of application No. PCT/DE2004/00327, filed on Feb. 21, 2004.

(30) Foreign Application Priority Data

Feb. 27, 2003 (DE) ..... 103 08 417

(51) Int. Cl.
*B66B 23/00* (2006.01)

(52) U.S. Cl. ..... 198/321; 198/326

(58) Field of Classification Search ..... 198/321, 198/326, 327, 328, 333, 833
See application file for complete search history.

(56) References Cited

U.S. PATENT DOCUMENTS

| | | | | |
|---|---|---|---|---|
| 3,365,051 A | | 1/1968 | Mullis et al. | |
| 3,395,648 A | * | 8/1968 | Ford et al. | 198/321 |
| 3,554,360 A | * | 1/1971 | Bildsoe | 198/833 |
| 3,893,564 A | * | 7/1975 | Raynor et al. | 198/833 |
| 5,595,278 A | | 1/1997 | Ostermeier et al. | |
| 6,085,891 A | | 7/2000 | Behle | |
| 6,607,064 B1 | * | 8/2003 | Inoue | 198/321 |
| 6,945,379 B1 | * | 9/2005 | Hauer et al. | 198/321 |

FOREIGN PATENT DOCUMENTS

| | | |
|---|---|---|
| DE | 909 559 B | 4/1954 |
| DE | 1 530 022 A | 9/1969 |
| DE | 2 061 400 A | 6/1972 |
| DE | 37 32 226 A1 | 4/1988 |
| DE | 42 29 238 A1 | 4/1993 |
| DE | 201 00 833 U1 | 5/2001 |
| EP | 0 013 792 A1 | 8/1980 |
| EP | 0 795 512 A1 | 9/1997 |

* cited by examiner

*Primary Examiner*—James R. Bidwell
(74) *Attorney, Agent, or Firm*—Venable LLP; Robert Kinberg

(57) ABSTRACT

A moving walkway includes at least one drive belt having one side arranged to engage a synchronizing disk and another side presenting fixing elements spaced apart in a longitudinal direction of the belt. Each of a plurality of pallets has at least one component to detachably engage with a corresponding fixing element on the drive belt so that the drive belt can move the pallets in a direction of conveyance. Each lateral side of each pallet includes an individual guide roller for engagement with a guideway. A rear area of one pallet and a front area of a following pallet, as seen in the direction of conveyance, define a supporting area such that a rear supporting area of each pallet is supported on a front supporting area of the following pallet.

11 Claims, 4 Drawing Sheets

MOVING WALKWAY

CROSS-REFERENCE TO RELATED APPLICATION

This is a continuation of International Patent Application No. PCT/DE2004/000327 filed Feb. 21, 2004, designating the United States and claiming priority of German Patent Application No. 103 08 417.7 filed Feb. 27, 2003, the disclosure of all of the foregoing applications being incorporated herein by reference.

BACKGROUND OF THE INVENTION

The invention relates to a moving walkway comprising a framework, which is provided for receiving a plurality of pallets, wherein the pallets comprise guide rollers and can be moved in the direction of conveyance by a drive mechanism.

German patent document DE-U 20 100 833 discloses an escalator or a moving walkway having a step or pallet band, which is driven by drive elements, which extend on both sides of the band or centrally beneath the band, and which rotate between respectively one reversing wheel and one drive wheel, wherein the steps or pallets are respectively driven at drive points of each drive element. Herein, the drive element is a toothed belt, which comprises blocks, wherein one block is respectively connected to one step or pallet at the drive point.

German patent document DE-A 3 732 226 describes a double sided toothed belt for driving an escalator which comprises two pulleys which are driven by a motor and which comprise a plurality of juxtaposed profiled teeth, a series of interconnected links, which are each provided with a plurality of juxtaposed teeth and are each connected with one of the steps, and a flexible toothed tension belt having a first and a second side, which each carries a plurality of juxtaposed teeth, of which the teeth of the first side comb via an arc with the teeth of the pulleys and the teeth on the second side comb linearly with the teeth of the links.

U.S. Pat. No. 3,365,051 describes a moving walkway, which works without reversing disks in the head zones thereof. On the head side, belt elements that can be driven are provided, which engage in correspondingly toothed areas of the pallets and form the drive means for the moving walkway, respectively the pallet band thereof. The individual pallets are interconnected via rollers.

U.S. Pat. No. 6,085,891 discloses a pallet body for moving walkways, which is composed of a tread plate having toothed front and rear edges, connecting elements for receiving and guiding connection and/or drive organs as well as tread plate supporting elements for receiving and guiding preceding or following pallet bodies, which are equipped with corresponding components, wherein the connecting elements, which are integrally formed with the tread plate, and the tread plate supporting elements are placed beneath the same one and project with predetermined distance over the front and rear edges of the tread plate. A chain, in particular a plate link chain is used as the drive mechanism. For minimizing gaps between adjacent pallets the teeth are interlocking.

U.S. Pat. No. 5,595,278 describes a passenger transport installation comprising a plurality of adjacent pallets, which are connected to each other by a pallet chain and are driven by the same one. The pallets are joined to each other with a hinge in the contact areas thereof by means of connecting elements, wherein several rollers are provided in the area of each pallet side.

Finally, European Patent document EP-A 13792 discloses a connection means for pallets of a moving walkway, wherein the pallets can be reversed around a vertical axis outside the transport area, such that two parallel transport areas are formed. Outside the transport areas, the pallets are automatically separated from the connection means, so that the pallets can be reversed without any problems. Outside the transport areas, i.e. beneath the comb plates, the individual pallets are automatically coupled again, such that the known continuous pallet band is again formed in the transport area.

SUMMARY OF THE INVENTION

It is an object of the invention to improve a generic moving walkway such that a stable guidance of the pallet band permits omission of a connection between the individual pallets, whereby a small reversing height in the respective reversing zone of the single pallets becomes possible.

The above and other objects are accomplished according to the invention by the provision of a moving walkway, comprising: at least one drive belt having one side arranged to engage a synchronizing disk and another side presenting fixing elements spaced apart in a longitudinal direction of the belt; and a plurality of pallets each having at least one component to detachably engage with one of the fixing element on the drive belt so that the drive belt can move the pallets in a direction of conveyance, the pallets each having lateral sides, each lateral side of each pallet including an individual guide roller for engagement with a guideway; wherein, as seen in the direction of conveyance, a rear area of one pallet and a front area of a following pallet define a supporting area such that a rear supporting area of each pallet is supported on a front supporting area of the following pallet.

According to an exemplary embodiment, each of the individual pallets is connected to the drive mechanism, in particular the respective drive belt, at only one point on each side. There is no other connection between the individual pallets. The advantage of this is that, without considering the polygon effect, the individual pallets can be easily reversed along a special guidance with a small reversing height of the pallets.

In order to prevent a tilting motion of the pallets, which are not connected to each other, in the area of the conveying distance or the return, the form of the pallets is designed such that they mutually support each other. This is realized in that opposed front and rear shoulders are provided, wherein, seen in the direction of conveyance, the respective rear shoulder of a pallet is supported on a corresponding front shoulder of a following pallet. The heights of the shoulders have to be designed such that no projecting ends are formed in the transport area. Furthermore, plastic elements can be inserted in the supporting areas of the pallets, which elements prevent any noise from being produced when the pallets interlock.

Two belts, which run in a synchronous manner, are advantageously used for conveying the individual pallets. In the head area of the moving walkway, the belts are reversed by means of two synchronizing disks, which are connected to each other by a shaft. As belts toothed belts, flat belts, V-belts and round belts can be used.

Fixing elements in the form of shoulders are provided on the back of the belts and serve for the connection of the individual pallets. The form and design of the shoulders can be different. The connection of the pallets to the respective belt is realized by either a firm shoulder-bolt connection or by a loose connection in form of a dog.

BRIEF DESCRIPTION OF THE DRAWINGS

The subject of invention is represented in the drawing by means of an exemplary embodiment and is described as follows. In the drawing.

DETAILED DESCRIPTION OF THE INVENTION

Figure 1:
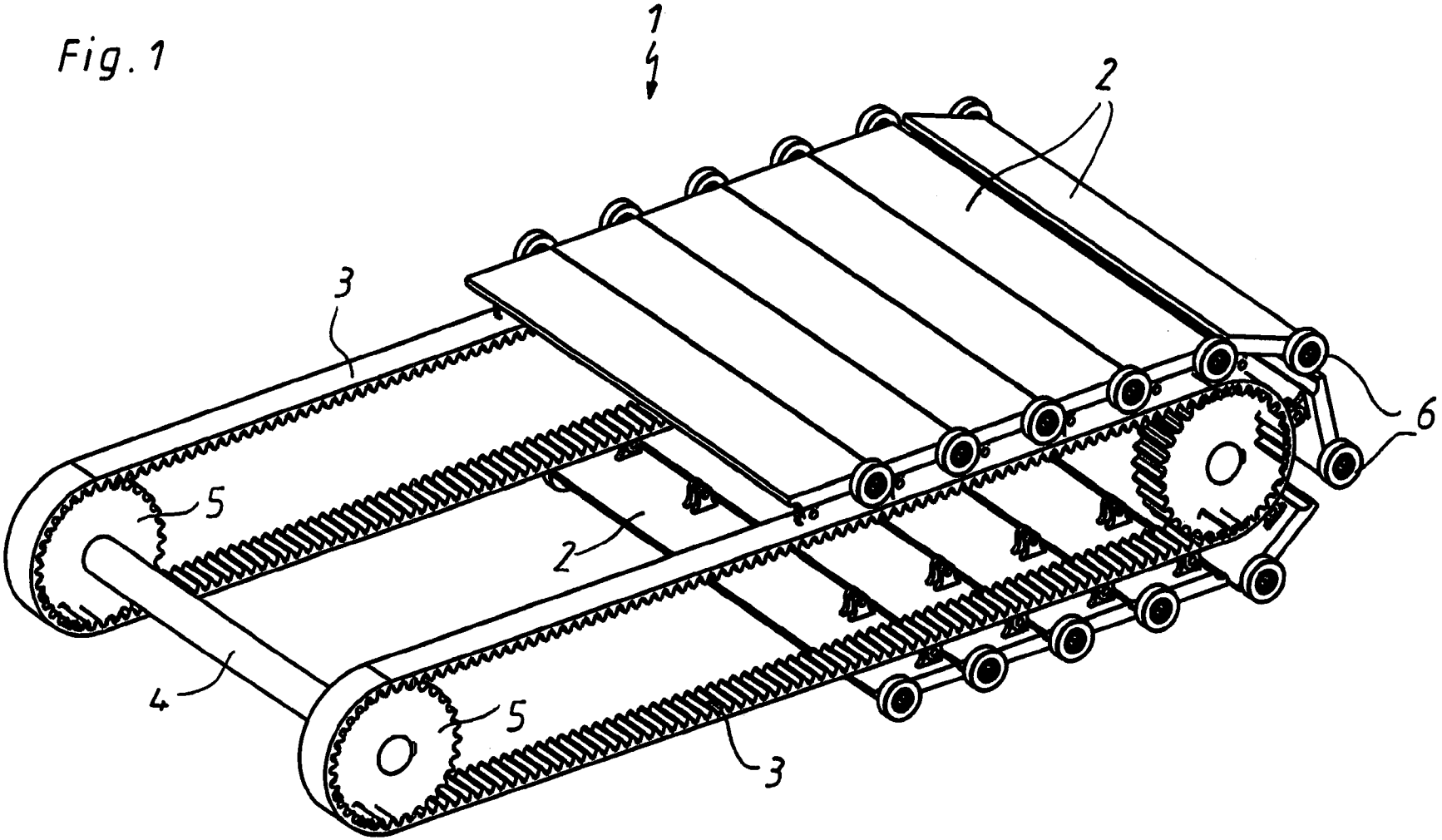
FIG. 1 is a schematic diagram of a reversible pallet band of a partially shown moving walkway in a perspective view.

FIG. 1 shows a rotating pallet band 1 comprising several individual pallets 2, which can be moved along a conveying distance by means of a drive mechanism 3, which is a toothed belt in this example. In the respective reversing area, two synchronizing disks, which are connected to each other via a synchronizing shaft 4, are provided, in the region of which the toothed belts 3, which run in a synchronous manner, can be reversed. Each lateral side of every pallet 2 has an individual guide roller 6, wherein the individual pallets are not connected to each other. The connection between the pallets 2 and the toothed belt 3 is realized by connecting mechanisms, which are explained in detail in the following figures.

Figure 2:
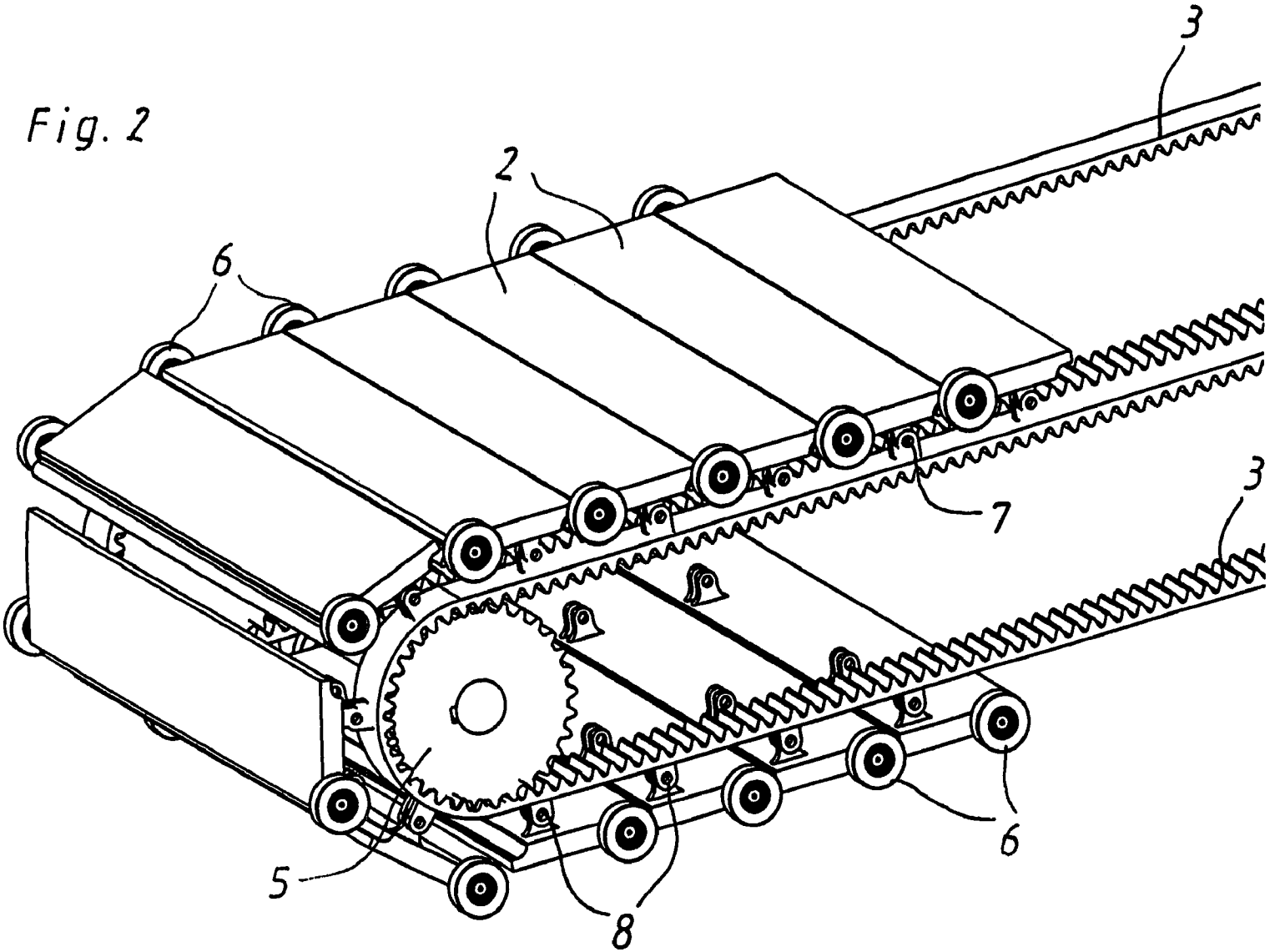
FIG. 2 is a partial representation of one of the reversing areas according to FIG. 1.

FIG. 2 shows one of the reversing areas. One can see individual pallets 2, a synchronizing disk 5 as well as the toothed belts 3 and the guide rollers 6. Furthermore, one can see fixing elements or shoulders 7, which are formed on the respective toothed belt 3 on the side of the pallets, and which can be detachably connected to correspondingly formed components 8 of each pallet 2.

Dependent on the respective pallet width, a very small reversing height of the pallets can be realized, which, in comparison to the state of the art, also entails small heights of the framework, which receives the pallet band.

This small pallet reversing height can also permit omission of the use of pits for receiving the framework body, and this one can rather be placed on the ground or floor area, wherein then only a ramp having a small height is required for stepping on the transport area.

Figure 3:
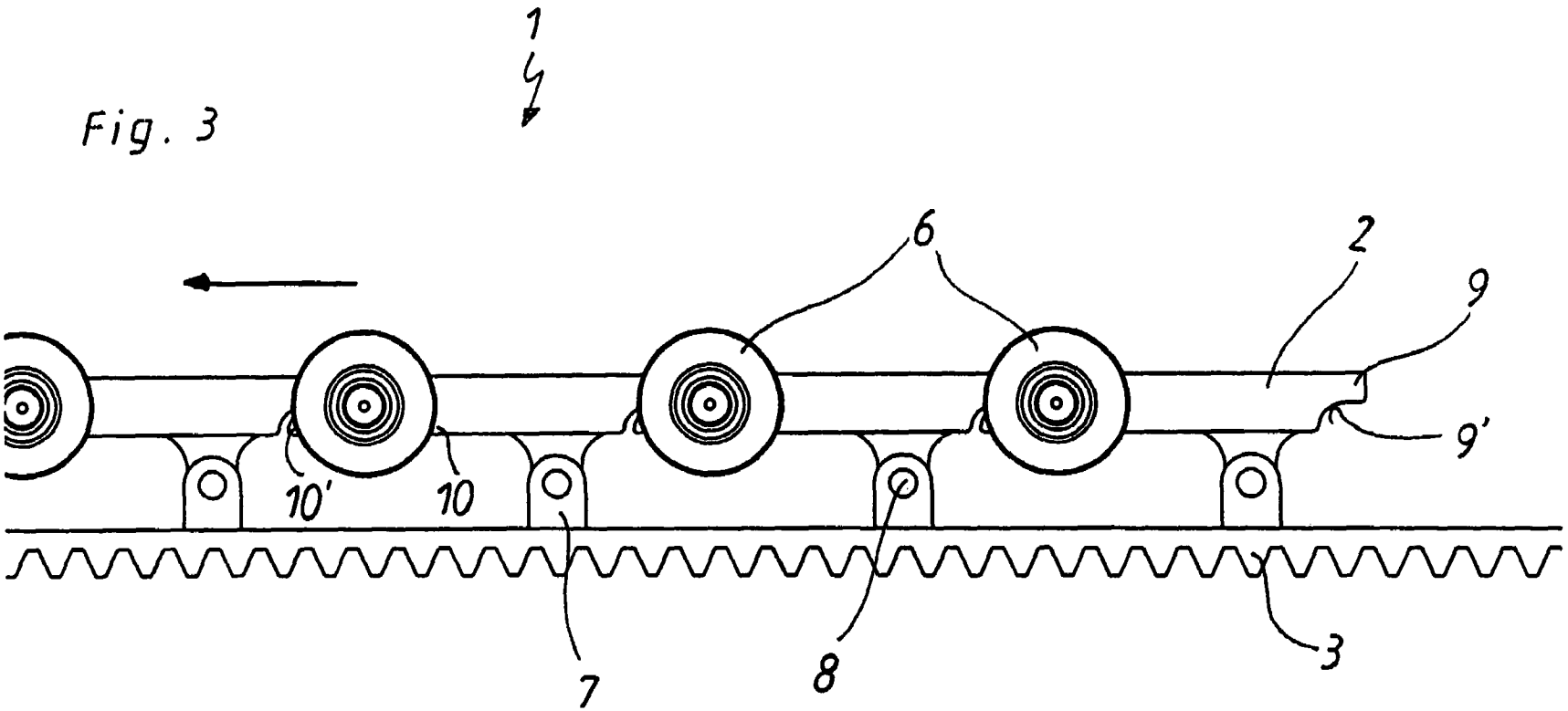
FIG. 3 is a side view of the rotating pallet band including the drive means.

FIG. 3 is a side view of a part of the rotating pallet band 1. Shown are the individual pallets 2, the (individual) guide rollers 6 connected thereto, the toothed belt 3, the cam-like shoulders 7, which are formed on the toothed belt 3 on the pallet side, as well as the corresponding components 8, which are integrally formed on said pallets 2. A detachable connection between the toothed belt 3 and the pallets 2 can be realized via a screw or bolt connection between the fixing elements 7 and components 8. The direction of conveyance is indicated by an arrow. The respectively rear area of every pallet 2 is provided with a shoulder 9. The respectively front area of the following pallet has an opposing shoulder 10. The shoulders 9, 10 form a supporting area. In the respective supporting area 9, 10, the individual guide roller 6 is arranged, which rolls on a here no further represented guideway. In this example, guide roller 6 is provided in the proximity of the shoulder 10. In order to prevent moments, it makes sense to displace the respective guide roller 6 into the area of the shoulder 10, as far as a sufficient material thickness is given. With respect to the width of every pallet 2, the coupling point of the components 7, 8 is displaced in the direction of the rear shoulder 9. Optionally (here not represented) plastic parts can be inserted in recesses in the area of said shoulders 9, 10, which parts lead to a noise reduction in this area. In the exemplary embodiment as shown, each of the individual pallets 2 is connected to the toothed belt 3 at only one point on each side. There is no other connection between the individual pallets 2. In order to prevent a tilting motion of the pallets 2, which are not connected to each other, in the area of the conveyance distance or the return, the shoulders 9, 10 of the individual pallets 2 are designed such that they mutually support each other. The front supporting area 10 of each pallet 2 has a rounded free end 10', whereas the rear supporting area 9 of each pallet 2 runs into the complete material section of pallet 2 via a curvature 9'.

Figure 4:
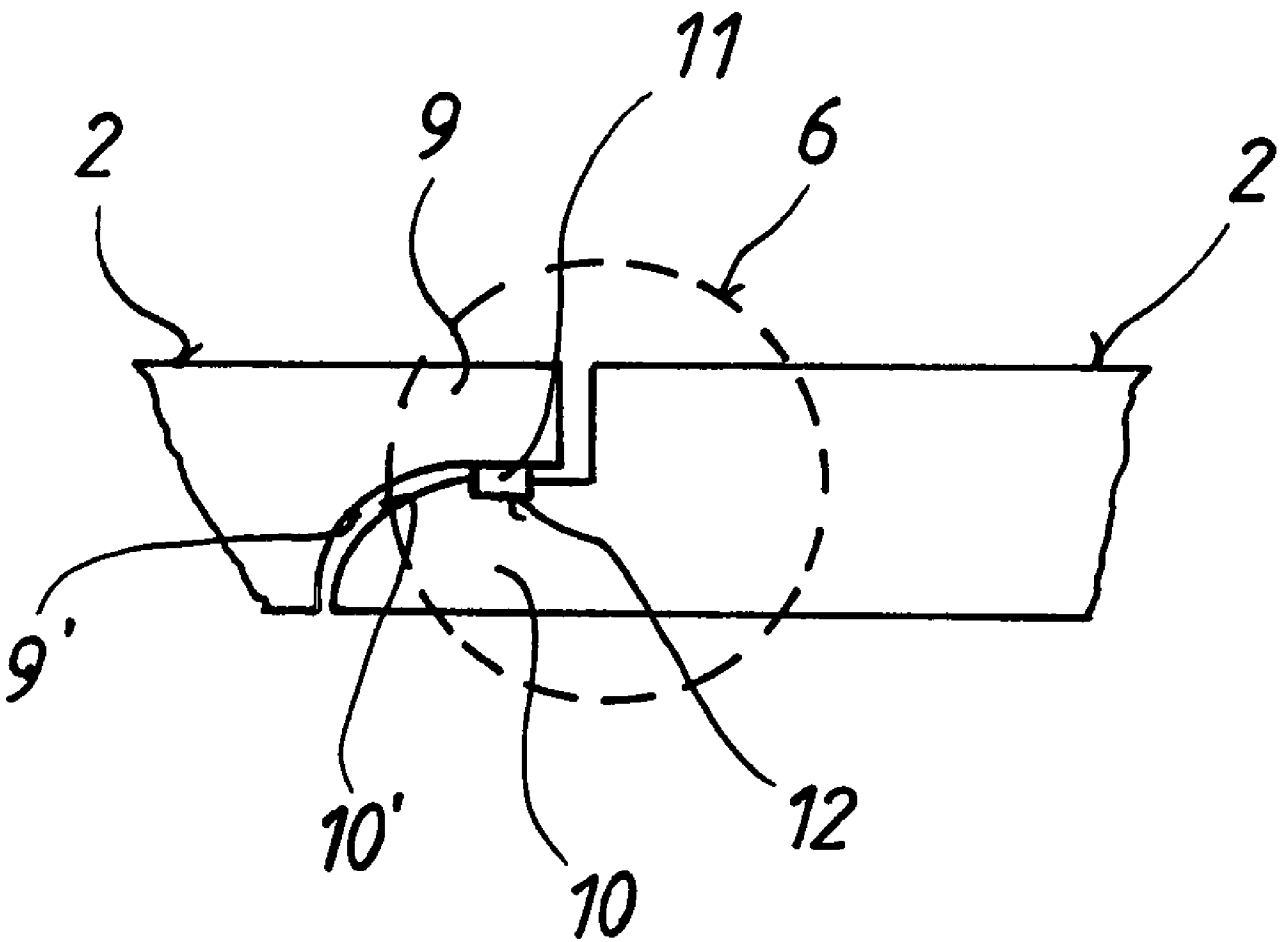
FIG. 4 is a partial representation of the side view of FIG. 3, including a plastic element.

FIG. 4 is a partial representation of the side view of FIG. 3. Shown are only two of the individual pallets 2. A guide roller 6 only is indicated. The respectively rear area of every pallet 2 is provided with the shoulder 9. The respectively front area of the following pallet 2 has an opposing shoulder 10. The shoulders 9,10 form the supporting area. The front supporting area 10 of each pallet 2 has the rounded free end 10', whereas the rear supporting area 9 of each pallet 2 runs into the complete material section of pallet 2 via the curvature 9'. The front area 10 of each pallet 2 comprises a plastic element 11 respectively inserted in an area 12 of the front supporting area 10. The plastic element 11 is in contact with the opposing shoulder 9 of the pallet 2.

The invention has been described in detail with respect to preferred embodiments, and it will now be apparent from the foregoing to those skilled in the art, that changes and modifications may be made without departing from the invention in its broader aspects, and the invention, therefore, as defined in the appended claims, is intended to cover all such changes and modifications that fall within the true spirit of the invention.

What is claimed is:

1. A moving walkway, comprising:

at least one drive belt having one side arranged to engage a synchronizing disk and another side presenting fixing elements spaced apart in a longitudinal direction of the belt;

a plurality of pallets each having at least one component to detachably engage with one of the fixing element on the drive belt so that the drive belt can move the pallets in a direction of conveyance, the pallets each having lateral sides, each lateral side of each pallet including an individual guide roller for engagement with a guideway;

wherein, as seen in the direction of conveyance, a rear area of one pallet and a front area of a following pallet define a supporting area such that a rear supporting area of each pallet is supported on a front supporting area of the following pallet.

2. The moving walkway according to claim 1, wherein each respective guide roller is located in proximity of the supporting area.

3. A moving walkway according to claim 1, wherein each respective guide roller is located in the supporting area and in the area of said component of the respective pallet.

4. A moving walkway according to claim 1, wherein the front area of each pallet includes a front shoulder having a rounded free end.

5. A moving walkway according to claim 4, wherein the rear area of each pallet includes a rear shoulder opposing the front shoulder on the following pallet and having a length essentially corresponding to a length of the front shoulder of the following pallet.

6. A moving walkway according to claim 4, wherein the respective rear supporting area of each pallet comprises an entire material section of the pallet with an inside curvature to receive the rounded free end of the front shoulder of the following pallet.

7. A moving walkway according to claim 1, wherein the at least one drive belt includes at least one drive belt for each lateral side of the plurality of pallets.

8. A moving walkway according to claim 1, wherein the at least one drive belt comprises one of a toothed belt, flat belt, V-belt or a round belt; the fixing elements include one individual fixing element for each pallet; and the components comprise two parallel components on each pallet between which the fixing element is guided and detachably connected to the parallel components by a screw and bolt connection.

9. A moving walkway according to claim 1, wherein the components are located near the respective rear supporting area of said pallets.

10. A moving walkway according to claim 1, further comprising plastic elements respectively inserted in an area of at least one of the front and rear shoulders.

11. A moving walkway according to claim 1, further comprising two synchronizing disks connected to each other by a shaft, wherein the at least one drive belt comprises two drive belts, one on each lateral side of the pallets, which run in a synchronous manner and are reversed in a reversing area of the moving walkway by the two synchronizing disks.

* * * * *